United States Patent [19]

Yokota et al.

[11] 4,081,959

[45] Apr. 4, 1978

[54] ARRANGEMENT FOR SUPPORTING A THERMAL REACTOR TO AN ENGINE PROPER

[75] Inventors: Akira Yokota, Yokosuka; Yasuhiko Nakagawa, Kamakura, both of Japan

[73] Assignee: Nissan Motor Company, Limited, Yokohama, Japan

[21] Appl. No.: 701,836

[22] Filed: Jul. 1, 1976

[30] Foreign Application Priority Data

Jul. 29, 1975 Japan ..... 50-105466[U]

[51] Int. Cl.[2] ..... F01N 7/10

[52] U.S. Cl. ..... 60/282; 60/322; 60/323

[58] Field of Search ..... 60/282, 322, 323, 324

[56] References Cited

U.S. PATENT DOCUMENTS

| | | | |
|---|---|---|---|
| 2,952,344 | 9/1960 | Pope | 60/323 X |
| 3,940,927 | 3/1976 | Maurhoff et al. | 60/322 X |

FOREIGN PATENT DOCUMENTS

| | | | |
|---|---|---|---|
| 1,213,670 | 3/1966 | Germany | 60/323 |
| 392,852 | 5/1933 | United Kingdom | 60/322 |

*Primary Examiner*—Carlton R. Croyle
*Assistant Examiner*—Michael Koczo, Jr.
*Attorney, Agent, or Firm*—Frank J. Jordan

[57] ABSTRACT

A bracket member is provided on a portion of a cylinder block of an engine for tightly supporting both an outlet duct of a thermal reactor and an end portion of an exhaust tube.

6 Claims, 3 Drawing Figures

ARRANGEMENT FOR SUPPORTING A THERMAL REACTOR TO AN ENGINE PROPER

The present invention relates in general to an arrangement for connecting an exhaust conduit system of an internal combustion engine to a motor vehicle body, and more particularly to the arrangement for tightly connecting a so called thermal reactor to the engine proper.

It is well known in the art that the thermal reactor is one of the useful devices which can reburn the unburned harmful combustible compounds, such as hydrocarbons (HC) and carbon monoxide (CO), contained in the exhaust gases from the engine for thereby converting these harmful compounds into harmless constituents.

In connection with the exhaust gas purifying effect of the thermal reactor, there is a tendency that the effect will increase accordingly as the temperature of the exhaust gases admitted into the reactor increases. Thus, it is an effective way to directly connect the thermal reactor to the engine proper without using any other medium conduit means so that the thermal reactor can receive therein the exhaust gases, from the engine, having the highest possible temperature. However, in using the above-mentioned arrangement, the outer shell of the thermal reactor is subjected to remarkable thermal stresses, which are caused by uneven heating of the shell due to the exhaust gases and will cause it to warp and finally to crack. This will require a thick wall construction of the outer shell to ensure the strength of the thermal reactor itself. With this construction, however, the thermal reactor fails to reach its optimum temperature rapidly due to the large thermal capacity thereof. Thus, during cold starting of the engine, it takes a considerably long time before the reactor can provide maximum performance.

Apart from this, a conventional thermal reactor recently used in the art is connected to the engine proper in such a manner that the exhaust gas inlet tubes of the reactor play an important role to fix the reactor proper to the engine proper. More specifically speaking, the connection between the engine proper and the reactor proper is made only through the exhaust gas inlet tubes extending from one longitudinal end of the reactor proper to the cylinder head of the engine proper. With this arrangement, there is generated a certain magnitude of internal stress at a portion of the cylinder head to which the exhaust gas inlet tubes are directly connected when the engine and the reactor are subjected to vibrations due to the engine running. This internal stress becomes more remarkable when the weight of the reactor is substantial. In the worst case, the cylinder head will be damaged.

Therefore, the present invention is proposed to eliminate the drawbacks encountered in the prior art arrangement used for firmly connecting or supporting a thermal reactor to an engine proper.

It is another object of the present invention to provide an arrangement including a thermal reactor which can achieve rapid warm-up thereof.

It is still another object of the present invention to provide an arrangement in which a thermal reactor is detachable from the engine proper without removing any other elemental parts of the motor vehicle.

Other objects and advantages of the arrangement according to the present invention will become more apparent from the following description when taken in conjunction with the accompanying drawings, in which.

Figure 1:
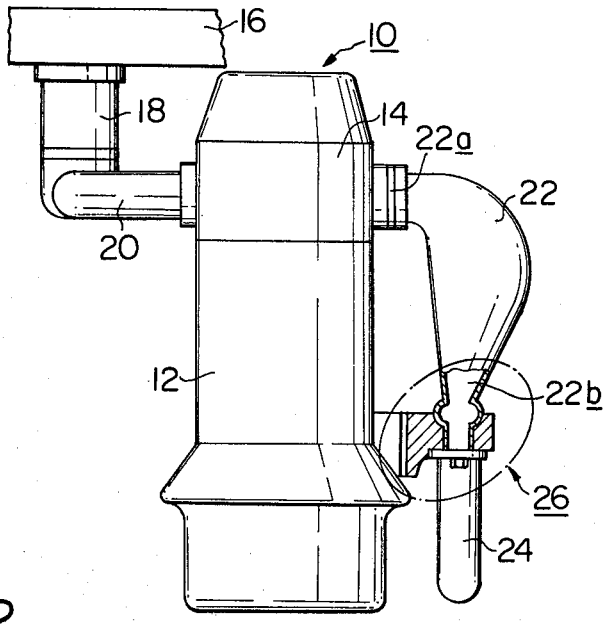
FIG. 1 is a side view of an internal combustion engine equipped with a thermal reactor, which schematically shows the arrangement in accordance with the principal of the present invention.
Figure 2:
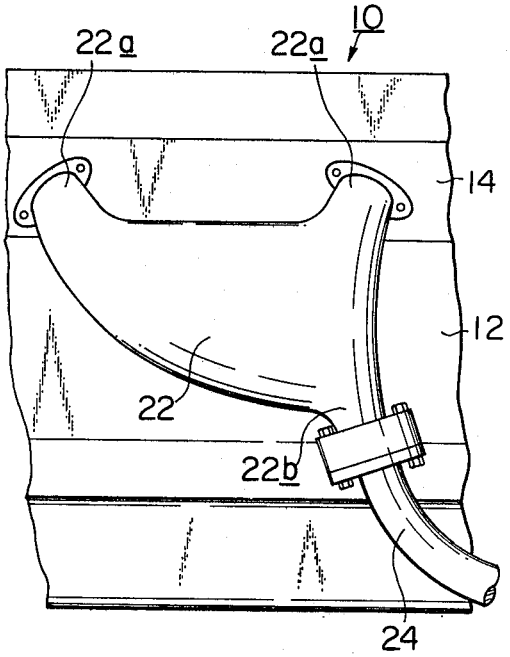
FIG. 2 is a front view of FIG. 1.

Referring now to FIG. 1 of the drawings, there is schematically illustrated an engine system employing an improved arrangement of the present invention to tightly connect the thermal reactor to the engine proper. Designated by reference numeral 10 in this drawing is an internal combustion engine proper which generally consists of a cylinder block 12 and a cylinder head 14. As is well known, the cylinder block 12 and the cylinder head 14 cooperate to define several combustion chambers between them, though not illustrated. An air filter 16, air-fuel mixture supply means 18 such as a carburetor, and an intake manifold or tube 20 are connected in series with each other and then connected to the cylinder head 14 at the position of the intake ports (not shown) in a conventional manner. Connected to exhaust ports (not shown) of the cylinder head 14 through its two exhaust gas intake tubes **22*a* is a thermal reactor 22 which has therein an aftercombustion chamber. The thermal reactor 22 is also provided with an outlet duct 22*b* to which an exhaust tube or pipe 24** is connected.

According to the present invention, there is further provided thermal reactor supporting means 26 which is so constructed to tightly support the thermal reactor 22 to the engine proper 10.

Figure 3:
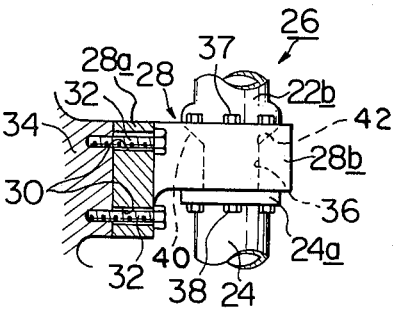
FIG. 3 is an enlarged partial view showing the encircled portion of FIG. 1.

As well shown in FIG. 3, the thermal reactor supporting means 26 comprises a bracket member 28 having a base portion **28*a* with bolt holes 30 through which bolts 32 are passed to connect the bracket member 28 to a portion 34 of the cylinder block 12. If desired, the portion 34 may be so formed to protrude as shown. Furthermore, each bolt hole 30 may be so formed to have a diameter considerably larger than that of each bolt 32** by a reason which will be described hereinlater.

The bracket member 28 further has a support portion **28*b* which has therein a through hole 36 to which the outlet duct 22*b* of the reactor 22 and one end of the exhaust tube 24 are connected from upper and lower sides of the support portion 28*b* respectively. In this embodiment, the end of the exhaust tube 24 is attached to the lower surface of the support portion 28*b* through a flange 24*a* and bolts 38, and the leading end of the outlet duct 22*b* is tightly inserted into the through hole 36 and held in place by means of bolts 37. However, the leading end of the outlet duct 22*b* may be just connected to an upper surface of the support portion 28*b* in the same manner as in the exhaust tube 24. If desired, the leading end of the outlet duct 22*b* may be formed with an enlarged portion 40 which is to be tightly set in an enlarged cut out portion 42 formed in the support portion 28*b* at the upper portion of the through hole 36**, as shown.

With this arrangement, the following merits and advantages will result.

(1) Since the thermal reactor is supported by the engine proper by way of so called triangularly spaced support points, the reactor and the engine proper are substantially integrally vibrated during the engine operation. Thus, the damage of the cylinder head which has occurred in prior art arrangements will be eliminated. By this improved supporting arrangement, the thermal reactor can be made with a relatively thin plate so that quick warm up of the reactor is expected.

(2) Since the exhaust tube is connected to the bracket member independently from the thermal reactor, the removal of the thermal reactor from the engine proper can be made without moving the exhaust tube. This will facilitate the assemblage operation of the engine system.

(3) Since each of the bolt holes formed in the bracket member has a diameter considerably larger than that of the corresponding bolt passing therethrough, the longitudinal thermal expansion of the thermal reactor due to the exhaust gas heat will not affect the mechanical properties or arrangements of the engine system.

Although in the previous description, only one embodiment is shown, it is to be understood that the present invention is not limited to the embodiment and that various changes and modifications may be made without departing from the scope of the invention, as described in the appended claims.

What is claimed is:

1. In an internal combustion engine system comprising an engine proper including a cylinder block and a cylinder head which are assembled together to define therebetween combustion chambers, said cylinder head being formed therein with exhaust ports communicable with said combustion chambers; a thermal reactor having at its one side exhaust gas inlet tubes connected in said exhaust ports of said cylinder head and at its other side an exhaust gas outlet duct; an exhaust tube having an open end in communication with said exhaust gas outlet duct of said thermal reactor for receiving the gases emitted from said thermal reactor before discharging into the open air, the improvement comprising a common bracket member mounted on said engine block and means mounting said outlet duct of said thermal reactor and said open end of said exhaust tube on said bracket member.

2. An internal combustion engine as claimed in claim 1, in which said bracket member comprises a base portion firmly connected to said cylinder block, and a support portion formed with a through hole having opposite open ends to which said outlet duct of said thermal reactor and said open end of said exhaust tube are connected respectively by said mounting means.

3. An internal combustion engine as claimed in claim 2, in which said outlet duct of said thermal reactor has a leading end which is received in said through hole.

4. An internal combustion engine as claimed in claim 3, in which said outlet duct of said thermal reactor has a leading end formed with an expanded portion, said through hole having an enlarged section which receives said expanded portion.

5. An internal combustion engine as claimed in claim 3, in which said base portion of said bracket member is fixed to said cylinder block by means of bolts, each of said bolts having a diameter smaller than that of corresponding bolt holes in said base portion.

6. In an internal combustion engine system comprising an engine proper including a cylinder block and a cylinder head which are assembled together to define therebetween combustion chambers, said cylinder head being formed therein with exhaust ports communicating with said combustion chambers; a thermal reactor having exhaust gas inlet tubes connected to said exhaust ports of said cylinder head and an exhaust gas outlet duct; an exhaust tube communicating with said exhaust gas outlet duct of said thermal reactor for receiving the gases emitted from said thermal reactor before discharging into the open air, the improvement comprising a bracket member having a base portion connected to said cylinder block and a support portion formed with a through hole having opposite open ends to which said outlet duct of said thermal reactor and said open end of said exhaust tube are respectively connected by means of bolts.

* * * * *